United States Patent [19]

Ericsson

[11] 4,226,181

[45] Oct. 7, 1980

[54] METHOD AND APPARATUS FOR ADJUSTING THE POSITION OF A STENCIL RELATIVE TO A PRINTING TABLE

[75] Inventor: Sylve J. D. Ericsson, Tumba, Sweden

[73] Assignee: Svecia Silkscreen Maskiner AB, Norsborg, Sweden

[21] Appl. No.: 897,743

[22] Filed: Apr. 17, 1978

[30] Foreign Application Priority Data

Apr. 19, 1977 [SE] Sweden ..... 7704459

[51] Int. Cl.[2] ..... B41F 1/34; B41F 15/36; B41L 13/02

[52] U.S. Cl. ..... 101/129; 33/184.5; 101/127.1; 101/DIG. 12; 355/40

[58] Field of Search ..... 101/DIG. 12, 129, 127.1; 33/184.5; 355/40

[56] References Cited

U.S. PATENT DOCUMENTS

| | | | |
|---|---|---|---|
| 1,860,361 | 5/1932 | Huebner | 33/184.5 |
| 2,680,405 | 6/1954 | Faeber | 101/DIG. 12 |
| 2,711,691 | 6/1955 | Leavens | 101/DIG. 12 |
| 2,894,454 | 7/1959 | Hillier | 101/DIG. 12 |
| 2,984,910 | 5/1961 | LaCour | 33/184.5 |
| 3,151,400 | 10/1964 | Schmitt | 101/DIG. 12 |
| 3,566,788 | 3/1971 | Hans | 101/DIG. 12 |
| 3,926,112 | 12/1975 | Neman | 101/127.1 |
| 3,943,851 | 3/1976 | Inada | 101/127.1 |

FOREIGN PATENT DOCUMENTS

| | | | |
|---|---|---|---|
| 228758 | 9/1959 | Australia | 101/DIG. 12 |
| 750458 | 6/1956 | United Kingdom | 101/DIG. 12 |

*Primary Examiner*—Clyde I. Coughenour
*Attorney, Agent, or Firm*—Burns, Doane, Swecker & Mathis

[57] ABSTRACT

A method and an apparatus for adjusting the position of a stencil relative to a printing table, characterized by (a) applying a transparent material to the printing table over a reference pattern, (b) transferring the stencil pattern onto the transparent material, e.g. by printing, (c) compensating for and eliminating any deviation between the printing pattern and the reference pattern by displacing the transparent material with the pattern printed thereon so that the pattern coincides with the reference pattern, and (d) adjusting the position of the stencil and a frame carrying the stencil in the same manner as the position of the transparent material was adjusted.

5 Claims, 2 Drawing Figures

METHOD AND APPARATUS FOR ADJUSTING THE POSITION OF A STENCIL RELATIVE TO A PRINTING TABLE

BACKGROUND OF THE INVENTION

The present invention relates to a method of adjusting the position of a stencil relative to a printing table, and in particularly relative to a reference pattern applied to the printing table, and apparatus for carrying out the method.

In silkscreen printing machines, the stencil with associated frame is fixed relative to the stand of the silkscreen printing machine. The printing table, which may be reciprocatingly movable, is also fixed relative to the stand of the printing machine.

In silkscreen printing machines it is a prime desire that the pattern assigned to the stencil be precisely positioned in relation to the material fixedly oriented to the printing table via registering means. It is practically always necessary to adjust the stencil (or the printing table) before the pattern obtains its exact position on the material. This adjustment has been found to be complicated and, above all, time consuming.

For the purpose of adjustment, it is previously known to apply a reference material to the registering means of the printing table and then move the printing table to the printing position and thereafter to apply the stencil pattern to the reference material. When the reference material is again moved back to the infeed position, it is possible to establish whether the stencil pattern deviates from the desired position, i.e. the pattern of the reference material, and if so by how much. In order to compensate for this deviation it is necessary to adjust the stencil pattern in relation to the material, since the material is fixedly related to the registering means with reference to a special position on the printing table.

In order to enable the stencil pattern to be adjusted, it has previously been proposed to hold the stencil in a first frame which, in turn, is held by but rotatably and displaceably arranged in a further frame. This further frame is fixed relative to the machine stand.

When a deviation has been established, it is necessary to adjust the first frame of the stencil relative to the other frame, this being effected by means of a plurality of setting devices. The setting devices are activated, however, "by instinct" and are set to such values that the stencil pattern can be assumed to be placed exactly on the material. Subsequent to actuating the setting devices, a further print is made on a reference material to establish whether the setting approaches the desired exact setting or not. This setting work has been found extremely complicated, perhaps primarily because the setting is not only oriented in the "x" and "y" direction, i.e. at right angle coordinates, but normally requires the stencil to be twisted.

OBJECT OF THE INVENTION

An object of the present invention is to enable the setting to be made in a much simpler manner than was previous possible with the use of simple means and to obtain said setting by normally one single adjustment.

BRIEF DESCRIPTION OF THE DRAWINGS

The specific properties of the invention will now be described in more detail with reference to the accompanying drawing, in which.

DETAILED DESCRIPTION OF A PREFERRED EMBODIMENT

Figure 1:
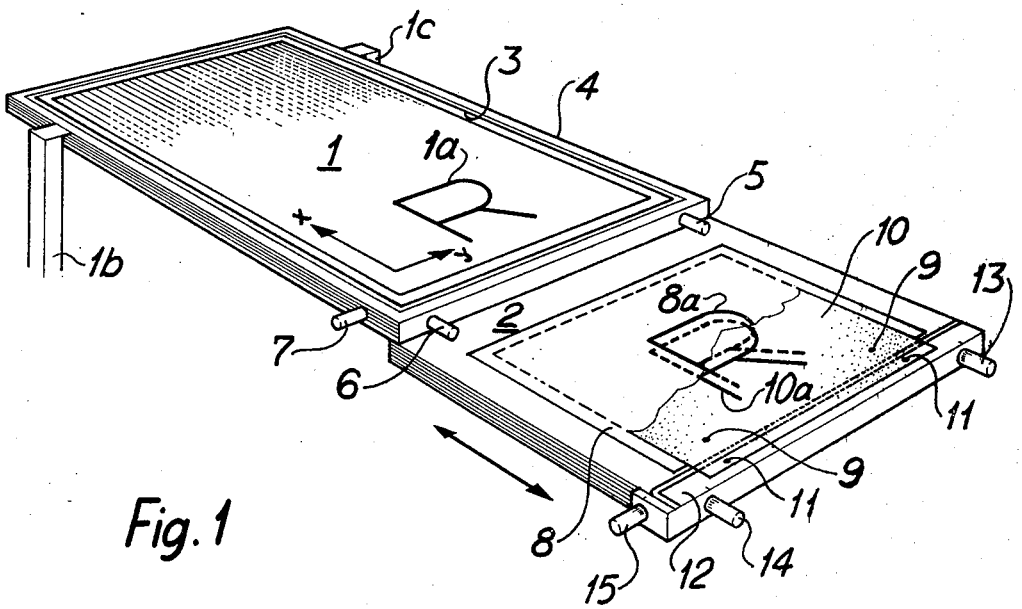
FIG. 1 is a perspective view, greatly simplified, of a silkscreen printing machine with associated stencil and reciprocatingly movable printing table.

The method according to the invention of adjusting the position of a stencil 1 relative to the position of a printing table 2 is based on the fact that the stencil 1 is held tensioned in an inner first frame 3 which, in turn, is held by and placed in an outer, second frame 4. The inner frame 3 can be moved to different positions relative to the outer frame 4 by three setting devices 5, 6 and 7. By simultaneously actuating the setting means 5 and 6 equally, the inner frame 3 is moved relative to the outer frame 4 in the direction of the coordinate "x", while actuation of the setting means 7 causes the inner frame 3 to move in the direction of the coordinate "y" relative to the outer frame 4. Different degrees of actuation of the setting means 5 and 6 causes the frame 3 to be twisted in the outer frame 4. By means of this arrangement it is thus possible to adjust each small deviation, irrespective of how it occurs.

The structural design of the setting means 5, 6 and 7 is previously known and does not form any part of the present invention.

The outer frame 4 is capable of being raised and lowered but is, nevertheless, fixedly related to the stand of the printing machine, of which stand only supports **1*b* and 1*c* are illustrated in FIG. 1. The printing table 2 is reciprocatingly movable but is, nevertheless, fixedly related to the stand 1*b* and 1*c*** of the printing machine.

In the infeed position of the printing table 2 there is applied to said table a material 8 exhibiting a reference pattern **8*a*. The material 8 is provided with a pattern 8*a* which is an exact replica of the pattern 1*a* exhibited by the stencil 1, namely "R". The stencil pattern is referenced 1*a* while the pattern of the material 8 is referenced 8*a*. The reference pattern 8*a* is fixed relative to the printing table 2 via a plurality of registering means 9. It is an object of the present invention to ensure that the pattern "R" of the stencil 1 obtains an exact position in relation to the pattern "R" on the material 8 during a printing operation. It is here suitable to assume that the stencil pattern 1*a* (R) printed on the material 8 gives a pattern which deviates from the position of the pattern 8*a* (R) and that it is therefore necessary to displace the stencil pattern 1*a* in the second frame 4 in a manner such that, when printing, the pattern 1*a* will be placed exactly over the pattern 8*a***.

In order to facilitate this adjustment procedure there is placed over the material 8 having the reference pattern **8*a* a transparent material 10 which, via registering means 11, is fixed relative to and held to the printing table 2. The registering means 11 are placed on a beam 12** joined to the printing table, the nature of which beam will be described in more detail hereinafter.

When the printing table 2 is moved to the printing position, i.e. immediately beneath the stencil 1 and the stencil pattern **1*a* is applied to the transparent material 10, it can be established when moving the table 2 to the infeed position, i.e. the position shown in FIG. 1, whether there is any deviation between the reference pattern 8*a* and the print or pattern which has been obtained from the stencil 1, namely the pattern 10*a***.

In FIG. 1 it has been shown that the deviation necessitates displacement of the print or pattern 10*a* in the direction of the coordinate "y" and also in the direction of the coordinate "x". By displacing the transparent material 10 via setting means 13, 14 and 15, in a manner such that the printed pattern 10*a* is located immediately above the reference pattern 8*a*, the setting position of the setting means 13, 14 and 15 can be read off and a corresponding setting can be transferred directly to the setting means 5, 6 and 7. Naturally, it is a prerequisite that displacement of the transparent material 10 by maneuvering the setting means 13, 14 and 15 takes place in the same manner as displacement of the stencil 1 in the frame 4 by maneuvering the setting means 5, 6 and 7. Thus, if the setting means 13, 14 and 15 are graduated in the same manner as the setting means 5, 6 and 7 and the setting means 5, 6 and 7 are set to that graduation measured on the setting means 13, 14 and 15 when the printed pattern 10*a* is located immediately above the pattern 8*a*, the inner frame 3 with the stencil pattern 1*a* can thus be moved by the setting means 5, 6 and 7 in exactly the same manner. Thus, there is hereby ensured an exact relationship of the stencil pattern 1*a* with the reference pattern 8*a*.

Figure 2:
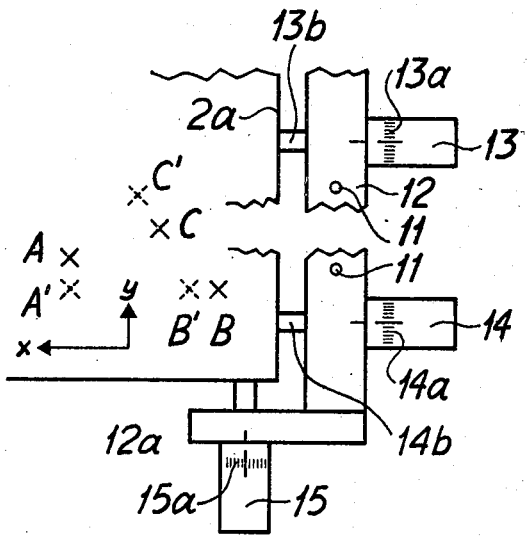
FIG. 2 is a horizontal view illustrating setting means applied on the leading edge of the printing table.

FIG. 2 is a horizontal view of the edge surface of the printing table 2 with setting means 13, 14 and 15. The setting means 13, 14 co-act with the edge surface 2*a* of the table and are arranged to cooperate with a beam 12 carrying the registering means 11 for the transparent material 10. Conveniently the setting means 13 and 14 are rotatably mounted in beams 1*e* and a part 13*b* and 14*b* provided with screw threads extend into the edge surface 2*a* of the printing table and mesh with a respective nut mounted in a groove extending parallel with the edge surface 2*a*, said groove guiding movement of the nuts in the direction of the "y" coordinate. By actuating the setting means 13 and 14 to an equal extent and in the same direction the transparent material 10 is moved in the direction of the direction of "x" coordinate, while rotation or actuation of the setting means 15, which also cooperates with the beam 12 in the manner described above but via an angled part 12*a*, causes the transparent material to be moved in the direction of the "y" coordinate. This means that if the reference pattern 8*a* has a point located in "A" while the transparent material obtains a corresponding printed point located at "A'" it is only necessary to actuate the setting means 15. If, on the other hand, the reference pattern has a point located at "B" it is necessary to actuate the two setting means 13 and 14 equally in order to move the point "B'" immediately above the point "B". If, on the other hand, the reference pattern has a point "C" while the stencil pattern provides a print on the transparent material 10 at point "C'", it is not only necessary to displace in the "y" direction and "x" direction but also to rotate the transparent material, this being effected by actuating the setting means 13 and the setting means 14, and possibly also the setting means 15.

Since setting of the means 13, 14 and 15 is effected whilst visually observing how the printed pattern 10*a* is slowly moved to correspond with the reference pattern 8*a*, the degree to which the setting means 13, 14 and 15 need be actuated is not too complicated.

The great advantage afforded by the present invention lies in the fact that the setting value of the setting means 13, 14 and 15 when the reference pattern and the transparent material coincide exactly can be transferred directly to the setting means 5, 6 and 7 for the stencil 1.

The method according to the invention, which is intended to adjust the position of a stencil relative to a printing table, or more specifically to a pattern on a material resting on the printing table, thus comprises the steps of first applying the stencil 1 to the inner frame 3, which in turn is movably arranged relative to the frame 4. A reference pattern 8*a* is then placed on the printing table 2. A transparent sheet of material 10 is then applied to the printing table over the reference pattern and is registered by means 11 in a beam 12 fixed to the printing table. The printing table 1 is moved to the printing position and the stencil pattern is transferred and applied (printed) to the transparent material 10. By means of this method it is possible to discern the difference or deviation between the printed pattern 10*a* and the reference pattern 8*a* in a simple manner and to compensate for and to eliminate any difference or deviation by displacing the printed pattern 10*a* on the transparent material 10 to coincide with the reference pattern 8*a*. This movement is then transferred to the stencil by causing the frame 3 carrying the stencil to be displaced to a corresponding degree in relation to the machine stand or the outer frame 4. Displacement of the printed pattern 10*a* to the reference pattern 8*a* is effected by actuating three setting means and when the printed pattern 10*a* coincides exactly with the reference pattern 8*a*, the positions of the setting means are read off and these settings transferred directly to the setting means for the frame of the stencil.

The invention is not restricted to the aforedescribed exemplary embodiments but can be modified within the scope of the inventive concept.

Respective setting means 5, 6, 7 and 13, 14, 15 are provided with markings 13*a*, 14*a*, 15*a* and have the form of spindles, micrometer spindles.

I claim:

1. A method for adjusting the position of a stencil relative to a printing table, comprising the steps of:

(a) placing a stencil having a pattern upon a frame and providing first adjustable registering means such that the position of the stencil relative to the frame can be adjusted;

(b) fixedly placing a reference pattern on the printing table, said reference pattern corresponding to said stencil pattern;

(c) placing a transparent material on the printing table over the reference pattern and providing second adjustable registering means such that the position of the transparent material relative to the printing table can be adjusted;

(d) transferring the stencil pattern to the transparent material;

(e) adjusting the second registering means to displace the transparent material relative to the printing table so that the positions of the transferred stencil pattern and the reference pattern coincide, and measuring the amount of such adjustment; and (f) adjusting the first registering means by the same measured amount to displace the stencil relative to the frame in the same manner and by an amount corresponding to the displacement of said transparent material to thereby provide registration between said stencil pattern and said reference pattern.

2. A method according to claim 1, characterized in that movement of the transferred pattern relative to the reference pattern is effected by activating a first set of three setting means and movement of the stencil relative to the frame is effected by activating a second set of three setting means, and when the pattern on the transparent material coincides exactly with the reference pattern, the setting of the first set of setting means is transferred directly to the second set of setting means for the stencil.

3. Apparatus for adjusting the position of a stencil relative to a printing table in a silkscreen printing machine, comprising:

a frame for supporting a stencil having a pattern;

first means for measurably adjusting the position of a stencil supported on said frame relative to the frame;

a printing table adapted to be brought into registry with a stencil supported on said frame;

a reference pattern fixedly mounted on said printing table;

means for registering the position of a material to be printed upon with respect to said printing table and said reference pattern; and second means for measurably adjusting the position of said registering means relative to said printing table and said reference pattern, said first and second adjusting means respectively providing corresponding measurable displacement of a stencil and a material to be printed upon, such that displacement imparted to a material to be printed upon by said second adjusting means can be directly measured and duplicated by said first adjusting means to move said stencil relative to said frame by a corresponding amount.

4. The apparatus of claim 3 wherein each of said first and second adjusting means comprises a set of three setting devices for providing lateral displacement in two mutually perpendicular directions within a plane and angular displacement within said plane.

5. The apparatus of claim 4 wherein each of said setting devices comprises a rotatable spindle having a calibrated scale marked thereon.

* * * * *